United States Patent [19]

Mandel et al.

[11] Patent Number: 5,040,857

[45] Date of Patent: Aug. 20, 1991

[54] DOOR HINGE ASSEMBLY FOR A REFRIGERATOR CABINET

[75] Inventors: Sheldon W. Mandel; Robert Katz, both of Galesburg, Ill.

[73] Assignee: Maytag Corporation, Newton, Iowa

[21] Appl. No.: 525,674

[22] Filed: May 21, 1990

[51] Int. Cl.[5] ..... A47B 81/00

[52] U.S. Cl. ..... 312/214; 16/364; 49/254

[58] Field of Search ..... 312/214, 116, 236, 322, 312/323, 329; 16/350, 352, 354, 357, 359, 360, 362, 364; 49/254, 257, 259

[56] References Cited

U.S. PATENT DOCUMENTS

| | | | |
|---|---|---|---|
| 116,686 | 7/1871 | Covert | 16/364 |
| 131,478 | 9/1872 | Tice | 16/364 |
| 154,995 | 8/1874 | Tripp . | |
| 1,472,457 | 10/1923 | Brown | 49/257 |
| 2,211,581 | 8/1940 | Ross | 16/364 |
| 2,975,013 | 10/1961 | Wallace et al. . | |
| 3,791,073 | 6/1974 | Baker . | |
| 4,411,046 | 10/1983 | Nawrath | 16/354 |
| 4,641,896 | 2/1987 | Iimura et al. | 49/257 |
| 4,780,929 | 11/1988 | Burns et al. | 16/360 |

FOREIGN PATENT DOCUMENTS

| | | | |
|---|---|---|---|
| 2574108 | 6/1986 | France | 16/362 |
| 480525 | 12/1969 | Switzerland | 16/354 |
| 8301647 | 5/1983 | World Int. Prop. O. | 16/362 |

OTHER PUBLICATIONS

Russin, Andrew; "Compensating Hinge", Aug. 1958; vol. 1, No. 2, p. 8.

*Primary Examiner*—Peter R. Brown
*Assistant Examiner*—Brian K. Green
*Attorney, Agent, or Firm*—Bacon & Thomas

[57] ABSTRACT

Uniform compression of a refrigerator door seal against the peripheral surface of the cabinet opening is realized by a pair of spaced hinge assemblies coupled for synchronized operation which, in automatic response to opening the door, shifts the hinge axis outwardly prior to permitting pivotal movement of the door about the hinge axis, and requires the door to be moved linearly inwardly while being maintained parallel to the plane of the cabinet opening during final closing of the door.

9 Claims, 4 Drawing Sheets

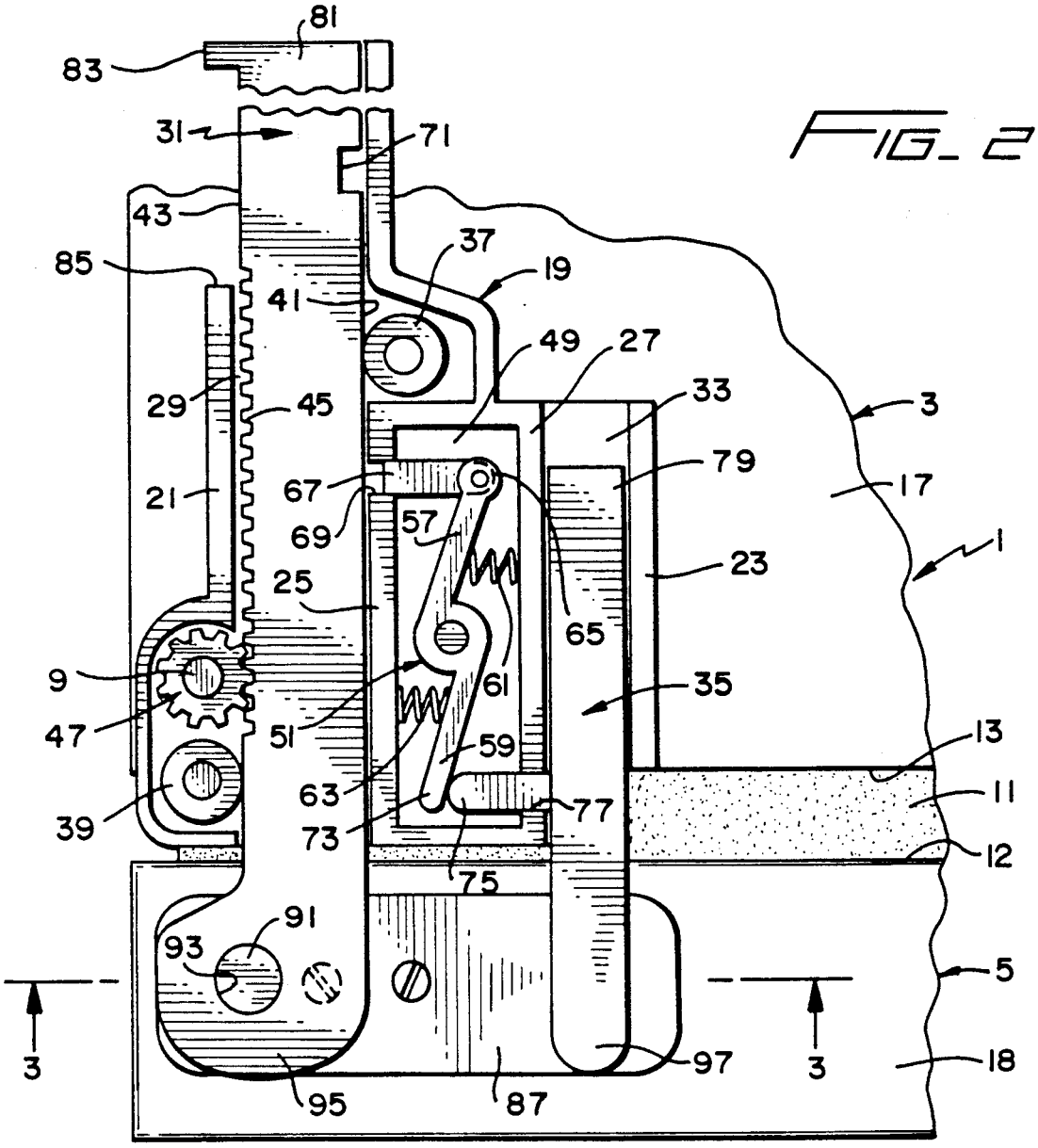
FIG. 2
FIG. 3
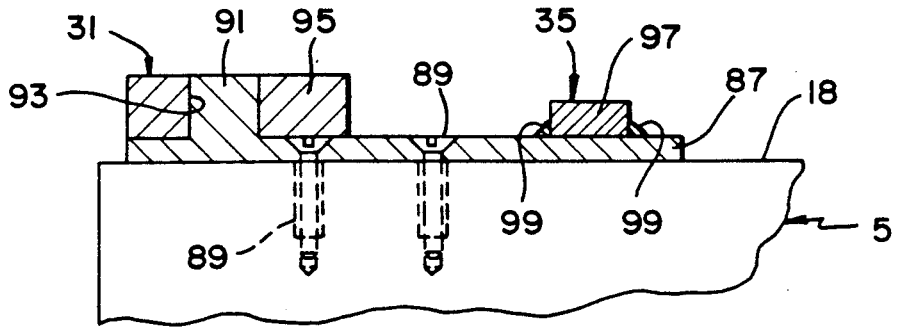

83
37
27
33
3
65
29
67
51
21
67
17
61
23
57
53
57
9
63
51
47
25
59
39
59
75
13
79
75
45
31
35
11
79
12
87
93
5
35
97
18
91
95
11
87
97
5

DOOR HINGE ASSEMBLY FOR A REFRIGERATOR CABINET

BACKGROUND OF THE INVENTION

1. Field of the Invention

The present invention generally involves the field of technology involving devices for pivotally mounting a door to a cabinet for closing an opening formed in a wall of the cabinet. In particular, the invention relates to an improved hinge assembly for mounting a door on a refrigerator cabinet wherein the door is provided with a sealing gasket that is compressed around the peripheral surface of the cabinet opening.

2. Description of the Prior Art

The food storage compartment of a conventional refrigerator cabinet is provided with a door which is mounted to the cabinet for pivotal movement about a vertical hinge axis that is defined by a pair of spaced hinges attached to corresponding edge portions of the cabinet and door. The inside surface of the door is provided with a circumferential gasket for sealing engagement against a corresponding peripheral surface around the cabinet opening to prevent energy loss when the door is closed. The pivotal movement about the hinge axis during closing of the door necessarily creates a wiping of the gasket against portions of the peripheral surface around the cabinet opening, particularly in the region along the corresponding edge portions of the cabinet and door. This situation prevents the uniform compression of the entire gasket and accelerates its wear.

The prior art has attempted to overcome these problems by providing a refrigerator hinge structure which, in automatic response to pivoting the door open about its hinge axis, causes the hinged edge of the door to be shifted in a direction transverse to the front wall of the cabinet. This permits a more uniform compression of the gasket around the cabinet opening during closing of the door. This arrangement serves the further purpose of permitting the cabinet to be installed in a corner with the side wall of the cabinet disposed adjacent a wall of the room projecting beyond the front of the refrigerator since the shifting of the hinged edge permits the door to be swung to a full right angled position without interference from the projecting wall.

Another problem arises when the inside surface of a refrigerator door within the perimeter of the gasket is provided with a door "dike" system. The door dike is in the form of a molded projection which extends outwardly from the inner surface of the door for defining shelf and storage within its perimeter. The dike extends inwardly into the refrigerated compartment formed by the food cabinet liner when the door is in its fully closed position. Since a conventional pivotal hinge assembly for a refrigerator requires that the door open and close about a fixed pivotal axis, it is required to radius or form the peripheral wall region of the dike inwardly in order to permit the door to open and close because of the projecting dike. This necessarily creates a large clearance between the peripheral wall region of the dike and the opposed adjacent portions of the food liner, a situation which results in energy loss if the door gasket is of insufficient construction or is not uniformly compressed against the peripheral surface of the cabinet opening.

In addition to the foregoing, it is also generally known to mount a door for pivotal movement about a vertical hinge axis wherein opening of the door requires an initial shifting of the hinge axis in one or more directions prior to permitting the door to pivot about the hinge axis. This arrangement is commonly found in hinge structures for mounting aircraft doors wherein, before it is permitted to pivot about its hinge axis, the door must first be displaced from a position in which the hinge axis makes an acute angle with the horizontal plane of the airframe to a position in which it is substantially perpendicular to the horizontal plane.

SUMMARY OF THE INVENTION

It is an object of the present invention to provide an improved hinge assembly for mounting an edge portion of a closure to a corresponding edge portion of an opening.

It is another object of the invention to provide an improved hinge assembly for mounting an edge portion of a door to a corresponding edge portion of a refrigerator cabinet opening whereby enhanced energy efficiency is realized through uniform compression of the entire door sealing gasket against the corresponding peripheral surface of the opening.

It is a further object of the invention to provide an improved hinge assembly for the door of a refrigerated cabinet which prevents premature wear or damage to the sealing gasket of the door.

It is yet another object of the invention to provide an improved hinge assembly for mounting a door to an opening for pivotal movement about a hinge axis whereby, in automatic response to opening the door, the latter is first shifted linearly away from the door opening prior to pivoting about the hinge axis and, upon closing the door, the latter is first pivoted into a position wherein it is disposed parallel with and spaced from the plane of the opening, and thereafter moved linearly into engagement with the peripheral surface of the opening.

It is still a further object of the invention to provide an improved hinge assembly for a door of a refrigerated cabinet of the type wherein the door is provided with an inwardly projecting dike system in order to permit a tight clearance between the dike and food cabinet liner to minimize energy loss when the door is in its closed position.

These and other objects of the invention are realized by providing a door hinge assembly for a refrigerator which includes a housing for attachment to the cabinet and a mounting plate for attachment to the door. A bar is slidably received within a first channel in the housing and includes an outer end pivotally mounted to a pin carried by the mounting plate for defining a hinge axis therewith. The other end of the bar is provided with a tang for limiting the outward extension of the bar. An arm is slidably received within a second channel formed in the housing and includes an outer end rigidly secured to the mounting plate. A spring-biased rocker arm is pivotally mounted within the housing for locking the bar in an outwardly extended position by a lock pin when the arm is fully withdrawn from its channel to permit pivoting of the door about the hinge axis only after the door has moved linearly away from the cabinet opening a maximum distance determined by the tang. The arm engages a release pin which pivots the rocker arm to withdraw the lock pin and require the door to move linearly towards the cabinet opening during final closing of the door when the arm is slidably received within the second channel, thereby effecting uniform compression of the door sealing gasket against the peripheral surface of the cabinet opening. A pair of hinge assemblies are preferably spaced at the top and bottom portions of the refrigerator and coupled for synchronized operation by a rod provided with gear pinions formed at its opposite ends for engagement with corresponding gear racks formed on the bars.

Other objects, features and advantages of the invention shall become apparent from the following detailed description of a preferred embodiment thereof, when considered in conjunction with the drawings wherein like reference characters refer to corresponding parts in the several views.

BRIEF DESCRIPTION OF THE DRAWINGS

FIG. 2 is a top plan view, partly broken away, showing a single hinge assembly with its housing cover removed and mounted to both the top wall of the cabinet and top surface of the door.

FIG. 3 is a cross-sectional view taken along the line 3—3 of FIG. 2.

DETAILED DESCRIPTION OF THE PREFERRED EMBODIMENT

Figure 1:
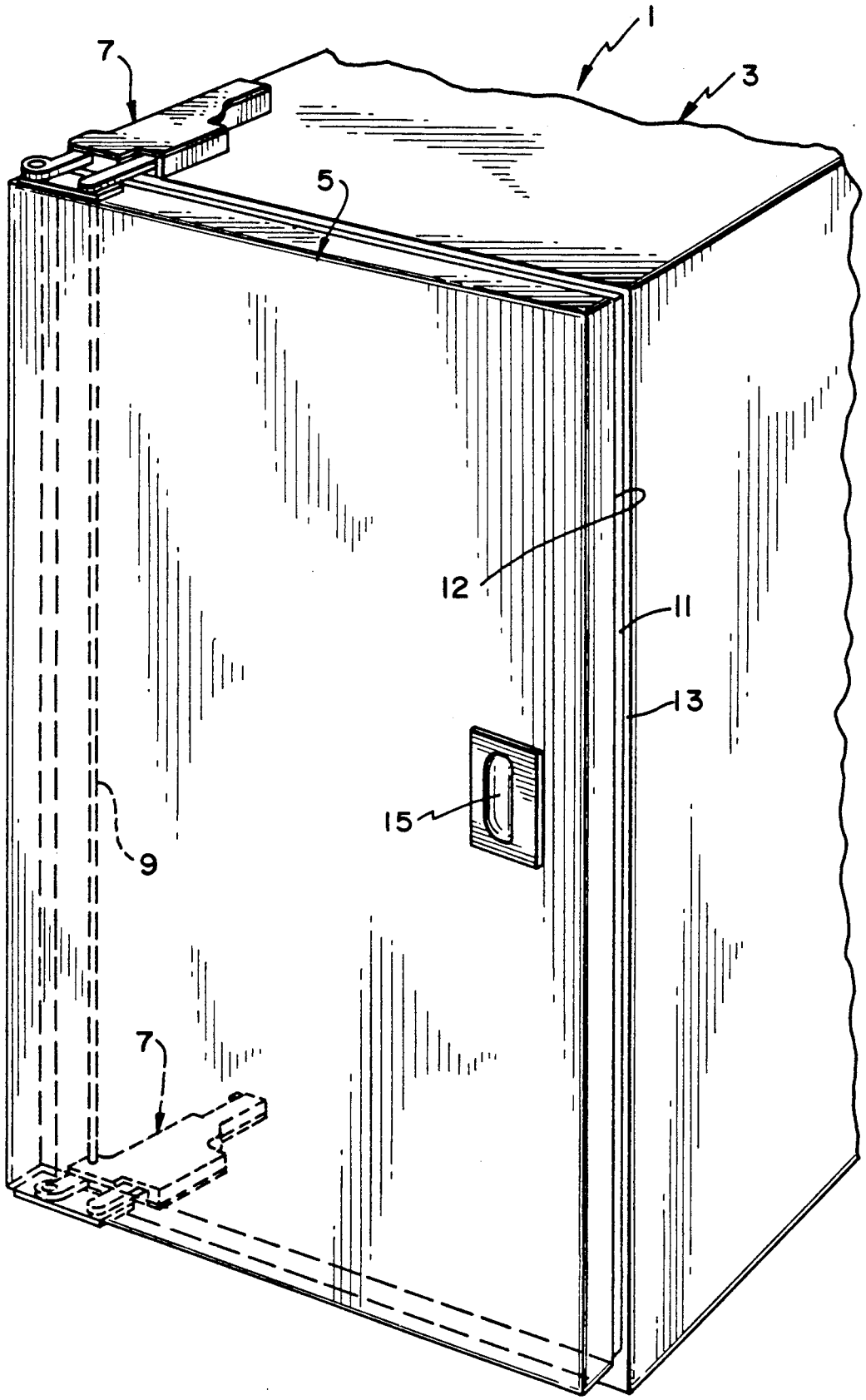
FIG. 1 is a perspective view, partly broken away, of a conventional refrigerator having a door mounted to the cabinet opening by a pair of hinge assemblies according to the invention, with the assemblies being spaced at the top and bottom of the refrigerator and coupled for synchronized operation.

A conventional refrigerator 1 is shown in FIG. 1 and includes a cabinet 3 and a door 5 secured to cabinet 3 for pivotal movement along a vertical hinge axis defined by a pair of hinge assemblies 7 according to a preferred embodiment of the invention. Assemblies 7 are attached to corresponding upper and lower corner portions of refrigerator 1, and are also coupled for synchronized operation by a vertically extending synchronizer rod 9.

Door 5 is provided with a conventional sealing gasket 11 which extends circumferentially around the periphery of an inside surface 12 of door 5 for engagement against a corresponding peripheral surface 13 defining the opening of cabinet 3. Gasket 11 is of resilient construction and compressed against surface 13 when door 5 is in its fully closed position, as shown in FIG. 1, in order to prevent energy loss from the refrigerated interior of cabinet 3 to the ambient surroundings. Door 5 is also provided with an appropriate handle means 15 located opposite the pivotal hinge axis defined by assemblies 7.

Figure 4:
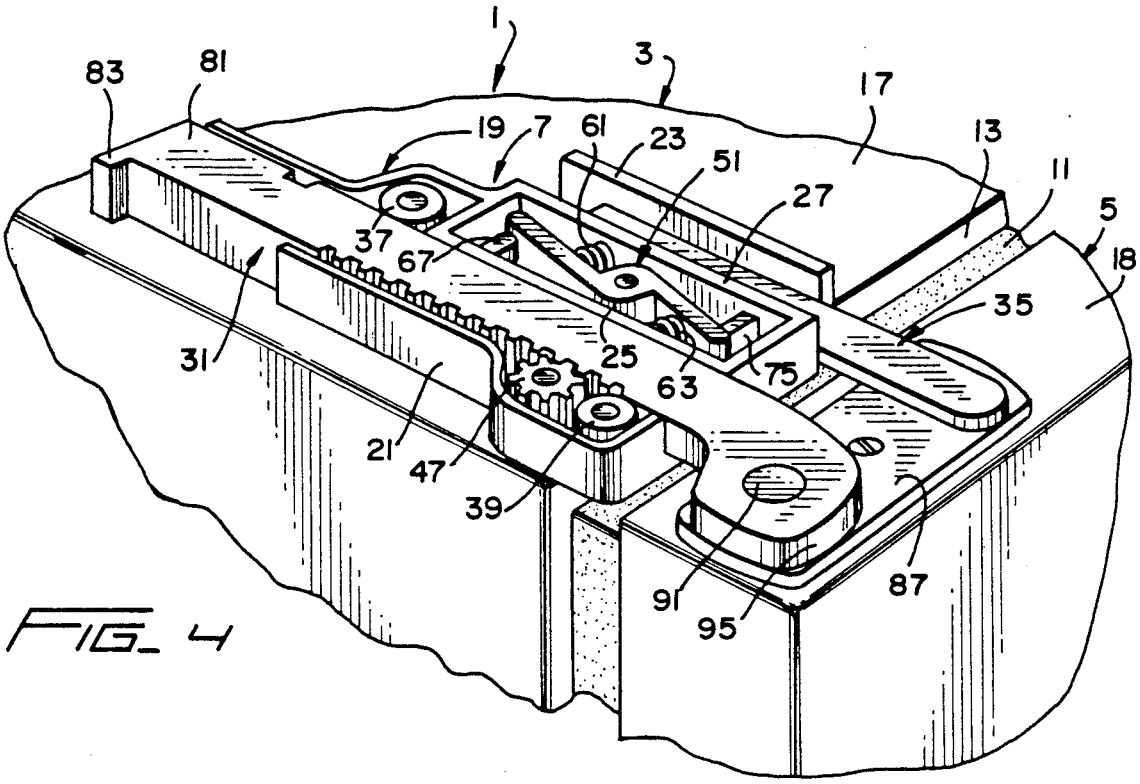
FIG. 4 is a partial perspective view of the hinge assembly shown in FIG. 2.

The structural details of hinge assembly 7 and the manner in which it is mounted to refrigerator 1 shall now be described with particular reference to FIGS. 2–4. As shown therein, assembly 7 is attached to refrigerator 1 on corresponding corner portions of a top wall 17 of cabinet 3 and a top surface 18 of door 5. It is understood that a similar assembly 7 is attached to a corresponding bottom wall and a corresponding lower surface of cabinet 3 and door 5, respectively, in the same basic manner and as previously depicted in phantom lines in FIG. 1.

Hinge assembly 7 includes a housing 19 formed in part from a pair of vertical outer walls 21, 23, a pair of vertical inner walls 25, 27, all of which walls are disposed in parallel, and a common bottom wall 28. Bottom wall 28 is preferably coextensive with all vertical walls of housing 19 and permits the latter to be secured to top wall 17 of cabinet 3 with mechanical fasteners or other appropriate fastening means. Outer wall 21 and inner wall 25 are spaced to define a first elongate channel 29 therebetween. An elongate bar 31 is disposed for sliding movement within channel 29. Similarly, outer wall 23 and inner wall 27 are spaced to define a second elongate channel 33 therebetween. An elongate arm 35 is disposed for sliding movement within channel 33. Housing 19 is also configured to receive a pair of thrust rollers 37, 39 for rolling engagement against a pair of opposed longitudinal edges 41, 43, respectively, of bar 31 during its sliding movement within channel 29. A gear toothed rack 45 is formed along a section of edge 43 for meshed engagement with a gear pinion 47 carried at the upper end of synchronizer rod 9.

As seen in FIG. 2, inner walls 25, 27 are spaced to define a chamber 49 therebetween within which a rocker arm 51 is disposed. The central portion of arm 51 is pivotally mounted to a pin 53 supported on bottom wall 28 of housing 19. Arm 51 includes a pair of oppositely extending elongate first and second members 57, 59, respectively. A first coil spring 61 is disposed between member 57 and inner wall 27, and a second coil spring 63 is disposed between member 59 and inner wall 25 to provide opposing resilient biasing forces for substantially centralizing the longitudinal axes of members 57, 59 within chamber 49. An outer end 65 of member 57 is pivotally connected to one end of a lock pin 67, with the other end of pin 67 being extendable through an aperture 69 in outer wall 25 for engagement within a corresponding recess 71 formed in edge 41 of bar 31. An outer end 73 of member 59 is disposed in engagement with one end of a release pin 75, the other end of pin 75 being extendable through an aperture 77 in inner wall 27. Pin 75 is engageable by an inner end 79 of arm 35 for urging pin 75 through aperture 77 into chamber 49 and thereafter maintained in such retracted position by arm 35 when the latter is disposed within channel 33.

An inner end 81 of bar 31 is provided with a tang 83 extending outwardly from edge 43 for engaging a terminal edge 85 of outer wall 21 to limit the maximum outward extension of bar 31 from channel 29. As also shown in FIGS. 2–4, hinge assembly 7 includes a rectangular mounting plate 87 which is secured to top surface 18 of door 5 by a plurality of screws 89 or other appropriate fastening means. A cylindrical pin 91 extends upwardly from plate 87 and is disposed within a corresponding cylindrical recess 93 formed in an outer end 95 of bar 31. Pin 91 is rotatable within recess 93 and its central axis defines the pivotal hinge axis of door 5, which hinge axis extends vertically downwardly through the central axis of another pin 91 of corresponding hinge assembly 7 at the bottom of refrigerator 1. An outer end 97 of arm 35 is rigidly secured to plate 87 by a plurality of welds 99 or other appropriate securing means. As apparent in FIG. 2, the longitudinal axes of bar 31 and arm 35 are parallel to each other and perpendicular to the planes encompassing the inside surface 12 of door 5 and peripheral surface 13 defining the opening of cabinet 3 prior to pivoting door 5 about its hinge axis.

Figure 5:
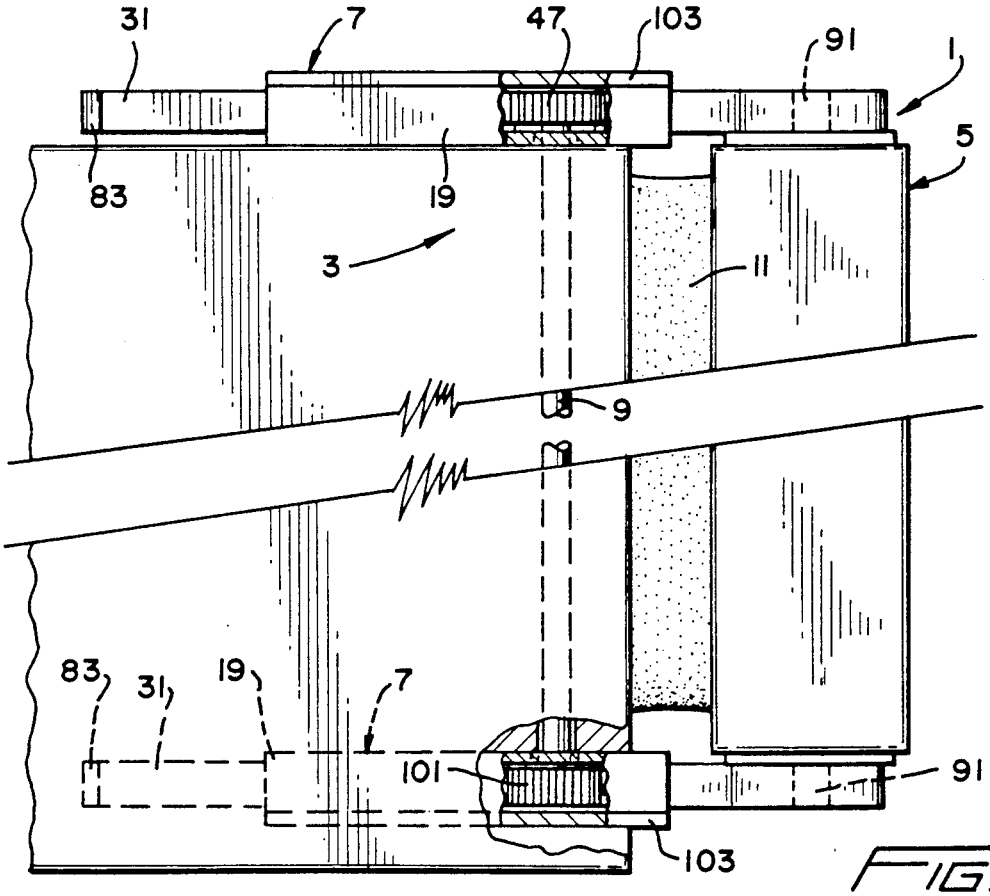
FIG. 5 is an expanded view, partly broken away, depicting the pair of hinge assemblies coupled for synchronized operation.

With reference to FIG. 5, there is shown a pair of hinge assemblies 7 mounted to the upper and lower portions of refrigerator 1 and coupled for synchronized operation by synchronizer rod 9. In addition to pinion gear 47 carried by the upper end of rod 9, there is also provided a corresponding pinion gear 101 carried by the lower end of rod 9 for meshed engagement with a corresponding gear toothed rack 45 formed in the slide bar 31 of lower assembly 7. Thus, rotation of pinion gear 47 in either a clockwise or counterclockwise direction results in a direct corresponding rotation of pinion gear 101 and vice versa.

As further indicated in FIG. 5, housing 19 of each hinge assembly 7 may be provided with an appropriate cover 103 for concealing the components contained therein. Assembly 7 and rod 9 may be constructed of any appropriate material deemed suitable for the practice of the invention as described herein, including metal, plastic or other such materials.

MODE OF OPERATION

Figure 6:
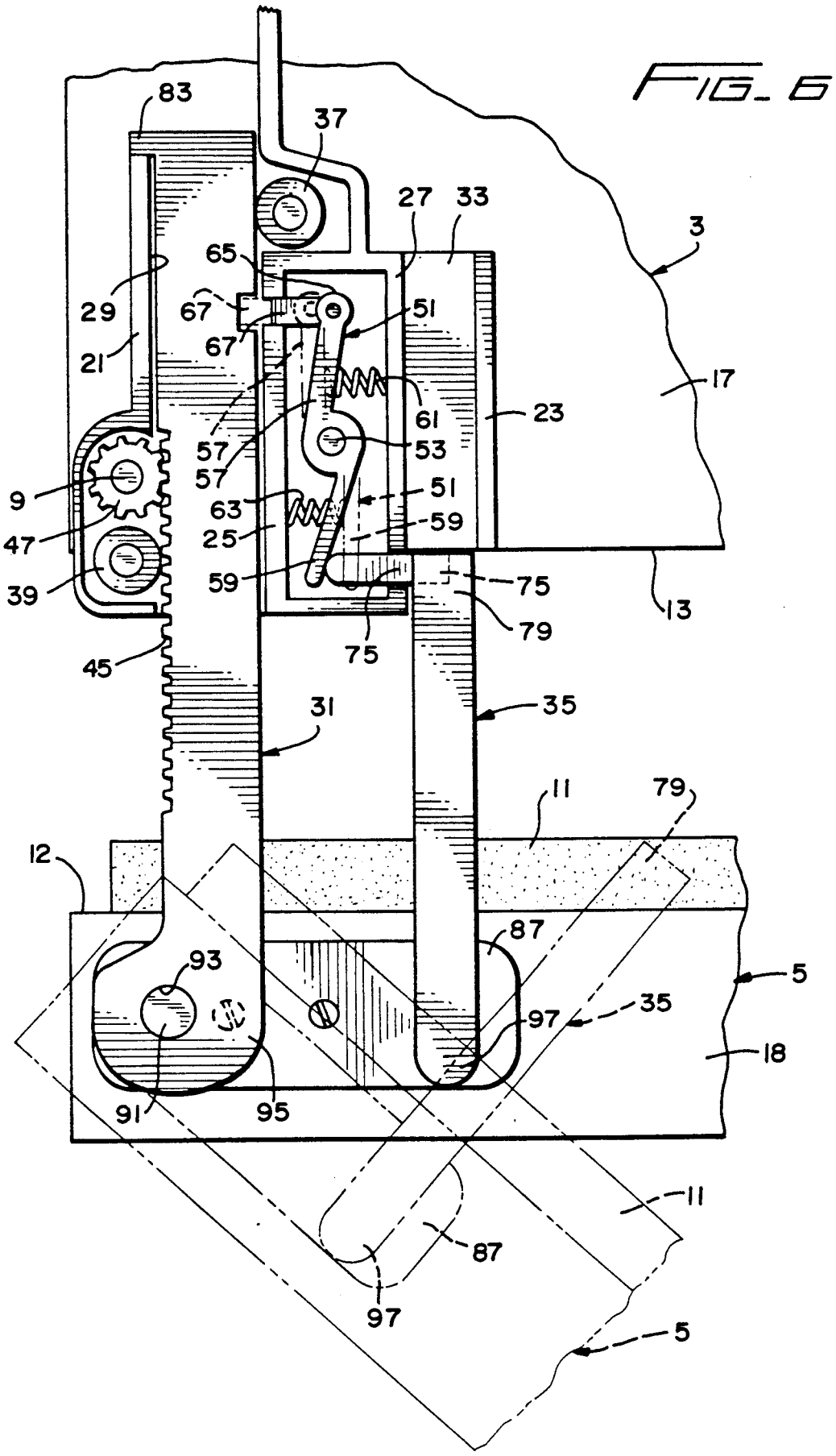
FIG. 6 is a top plan view depicting, in solid lines, the hinge assembly in a first position wherein the door is spaced from and parallel to the cabinet opening and, in phantom lines, a second position wherein the door is pivoted outwardly about the hinge axis.

The manner in which hinge assembly 7 of the invention operates to permit the opening and closing of door 5 with respect to cabinet 3 of refrigerator 1 shall now be described with particular reference to FIGS. 2 and 6.

As first seen in FIG. 2, door 5 is disposed in its fully closed position wherein gasket 11 mounted on inside surface 12 of door 5 is compressed in sealing engagement against peripheral surface 13 defining the opening of cabinet 3. When handle 15, as seen in FIG. 1, of door 5 is grasped by the user and pulled to open door 5, the latter is not permitted to immediately pivot about the hinge axis defined by pivot pin 91 due to the disposition of arm 35 within channel 33. Because of the antipivot effect imposed by arm 35, the application of pulling force on handle 15 requires door 5 and its hinge axis to first move linearly outwardly from cabinet 3 while being maintained parallel with respect to the front plane of cabinet 3 during such movement. This linear movement continues until door 5 and its hinge axis are disposed in the solid line position shown in FIG. 6 wherein door 5 remains parallel to and is spaced from peripheral surface 13 of cabinet 3. The latter position is determined by the engagement of tang 83 against terminal edge 85 of outer wall 21 which limits the maximum outward extension of bar 31. As seen in FIG. 6, this position disposes inner end 79 of arm 35 outwardly of channel 33, but maintains both release pin 75 and lock pin 67 in their fully retracted positions through rocker arm 51. Since tang 83 prevents any further outward linear movement of door 5 and arm 35 is fully withdrawn from channel 33, the continued application of pulling force on handle 15 causes door 5 to initiate pivoting movement about the hinge axis defined by pin 91. This results in the disengagement of inner end 79 of arm 35 from release pin 75, thereby permitting rocker arm 51 to rotate in the counterclockwise direction due to the opposed biasing forces imposed by springs 61, 63. This causes lock pin 67 to extend outwardly into engagement within recess 71, thus preventing inward retraction of bar 31. Door 5 is then permitted to continue pivoting outwardly about its hinge axis, as depicted in phantom lines in FIG. 6, and with the corresponding positions of rocker arm 51, lock pin 67 and release pin 65 being also depicted in phantom lines. Normally, door 5 may pivot outwardly to a position wherein is substantially perpendicular to the front of cabinet 3.

The closing of door 5 is accomplished by applying a pushing force on handle 15 which results in door 5 pivoting inwardly about the hinge axis. It is important to note that during such pivoting, the hinge axis defined by pin 91 remains stationary due to the engagement of lock pin 67 within recess 71 of bar 31, thus preventing the latter from being retracted inwardly within channel 29. However, when door 5 reaches the solid line position shown in FIG. 6, inner end 79 of arm 35 engages release pin 75 and causes its full retraction within cavity 49. This results in a clockwise rotation of rocker arm 51 against springs 61, 63, and the simultaneous full retraction of lock pin 67 from recess 71. Upon the continued application of pushing force on handle 15, bar 31 and arm 35 are caused to be retracted within their respective channels 29 and 33. This permits door 5 to then move linearly inwardly, while remaining parallel to the front of cabinet 3. This latter movement also permits gasket 11 to uniformly contact and compress against peripheral surface 13 into sealing engagement therewith. As apparent, this prevents any uneven wiping of portions of gasket 11 during the closing procedure, thereby resulting in a more energy efficient sealing engagement of gasket 11 and preventing premature wear and damage thereto.

The aforedescribed opening and closing of door 5 is uniformly synchronized for both upper and lower hinge assemblies 7 coupled together by synchronizer rod 9, as shown in FIGS. 1 and 5. During the opening of door 5, both toothed racks 45 cause simultaneous clockwise rotation of both pinion gears 47, 101 of rod 9, when viewed from the top of refrigerator 1. Conversely, during closing of door 5, racks 45 cause simultaneous counterclockwise rotation of pinion gears 47, 101. Rod 9 therefore assures a smooth and synchronized operation of both assemblies 7 during the opening and closing of door 5.

The uniform compression of gasket 11 and the manner in which door 5 is opened and closed by assemblies 7 afford a particular advantage in those applications wherein a refrigerator door is provided with a dike system of the type previously discussed herein. Since assemblies 7 require door 5 to move linearly with respect to the cabinet opening during initial opening and final closing of door 5, it is now possible to provide door 5 with a projecting dike wherein the peripheral wall region of the dike need not be radiused inwardly, but instead formed so as to define a tight clearance between such wall region and the corresponding wall portions of the food cabinet liner. This results in an enhanced energy seal between the door and the cabinet, and also reduces the criticality of the door gasket structure which, in any event, shall always realize a uniform compression by virtue of the invention.

Though hinge assembly 7 has been described in conjunction with refrigerator 1, assembly 7 may also be used with other forms of doors and cabinets, particularly when a compressible gasket is used to effect a sealing engagement between the door and peripheral surface of an opening.

It is to be understood that the form of the invention herein shown and described is to be taken as a preferred embodiment thereof, and that various changes in shape, material, size and arrangement of parts may be resorted to without departing from the spirit of the invention or scope of the subjoined claims.

We claim:

1. A hinge assembly for mounting a door to a cabinet opening defined by a peripheral surface and permitting the door to pivot about a hinge axis between open and closed positions, which assembly comprises:

a) a housing for attachment to the cabinet;

b) a mounting plate for attachment to the door, the mounting plate including a pivot pin;

c) an elongate bar slidably disposed in the housing for extension and retraction relative thereto between a maximum extension position and a full retraction position, limiting means for determining the maximum extension position of the bar, and the bar including an outer end engageable with the pivot pin to define a pivotal hinge axis for the door, whereby extension and retraction of the bar causes a respective outward and inward shifting of the hinge axis relative to the cabinet;

d) an elongate arm slidably disposed in the housing for extension and retraction relative thereto, the arm being extendable from the housing to a full withdrawal position, and including an outer end rigidly secured to the mounted plate; and e) locking means operable in response to disposition of the arm in the full withdrawal position and initial pivoting of the door for securing the bar against retraction in the maximum extension position and permitting the door to pivot outwardly about the hinge axis into the open position only when the full withdrawal position is reached.

2. The hinge assembly of claim 1 wherein:

a) the bar and the arm each includes a longitudinal axis;

b) the housing includes a first channel within which the elongate bar is slidably disposed and a second channel within which the elongate arm is slidably disposed; and c) the longitudinal axes of the bar and arm being in parallel when the bar and arm are disposed within their respective channels.

3. The hinge assembly of claim 1 wherein the means for limiting the maximum outward extension of the bar includes an outwardly extending tang carried by an inner end of the bar, and the tang being engageable against a stop means carried by the housing.

4. A refrigerator assembly comprising:

a) a cabinet having an opening defined by a peripheral surface;

b) a pair of hinge assemblies;

c) a door mounted to the cabinet opening by the pair of hinge assemblies for disposition between open and closed positions, the door including an inside surface, a circumferential gasket on the inside surface, and the gasket being compressible into sealing engagement against the peripheral surface of the opening when the door is disposed in the closed position;

d) one hinge assembly being mounted to corresponding upper portions of the cabinet and door and the other hinge assembly being mounted to corresponding lower portions of the cabinet and door, and a rod coupling the hinge assemblies for synchronized operation; and e) each hinge assembly including a housing attached to the cabinet, a mounting plate attached to the door, the mounting plate including a pivot pin, an elongate bar slidably disposed in the housing for extension and retraction relative thereto between a maximum extension position and a full retraction position, limiting means for determining the maximum extension position of the bar, the bar including an outer end engageable with the pivot pin to define a pivotal hinge axis for the door whereby extension and retraction of the bar causes a respective outward and inward shifting of the hinge axis, an elongate arm slidably disposed in the housing for extension and retraction relative thereto, the arm being extendable from the housing to a full withdrawal position, and including an outer end rigidly secured to the mounting plate, and locking means operable in response to disposition of the arm in the full withdrawal position and initial pivoting of the door for securing the bar against retraction in the maximum extension position and permitting the door to pivot outwardly about the hinge axis into the open position.

5. The refrigerator assembly of claim 4 wherein:

a) each elongate bar includes a gear toothed rack; and b) the rod includes a pair of gear pinions disposed in meshed engagement with the gear toothed racks.

6. The refrigerator assembly of claim 4, wherein:

a) each said bar and arm includes a longitudinal axis;

b) the housing includes a first channel within which the elongate bar is slidably disposed and a second channel within which the elongate arm is slidably disposed; and c) the longitudinal axes of each said bar and arm being in parallel when the bar and arm are disposed within their respective channels.

7. The refrigerator assembly of claim 4 wherein the limiting means includes an outwardly extending tang carried by an inner end of the bar, and the tang being engageable against a stop means carried by the housing.

8. The refrigerator assembly of claim 4 wherein the locking means includes:

a) a spring-biased rocker arm including a lock pin;

b) a recess formed in the bar for detachable engagement by the lock pin; and c) a release pin engageable by the elongate arm for maintaining the lock pin out of the recess.

9. A hinge assembly for mounting a door to a cabinet opening defined by a peripheral surface and permitting the door to pivot about a hinge axis between opened and closed positions, which assembly comprises:

a) a housing for attachment to the cabinet;

b) a mounting plate for attachment to the door, the mounting plate including a pivot pin;

c) an elongate bar slidably disposed in the housing for extension and retraction relative thereto between a maximum extension position and a full retraction position, limiting means for determining the maximum extension position of the bar, and the bar including and outer end engageable with the pivot pin to define a pivotal hinge axis for the door, whereby extension and retraction of the bar causes a respective outward and inward shifting of the hinge axis relative to the cabinet;

d) an elongate arm slidably disposed in the housing for extension and retraction relative thereto, the arm being extendable from the housing to a full withdrawal position, and including an outer end rigidly secured to the mounting plate; and e) locking means operable in response to disposition of the arm in the full withdrawal position and initial pivoting of the door for securing the bar against retraction in the maximum extension position and permitting the door to pivot outwardly about the hinge axis into the open position, the locking means including a spring-biased rocker arm provided with a locking pin, a recess formed in the elongate bar for detachable engagement by the lock pin, and a release pin engageable by the elongate arm for maintaining the lock pin out of the recess.

* * * * *